United States Patent [19]

Hodson

[11] Patent Number: 4,889,428

[45] Date of Patent: Dec. 26, 1989

[54] ROTARY MILL

[75] Inventor: Harry Hodson, Sarasota, Fla.

[73] Assignee: Concrete Technology Corporation, Santa Barbara, Calif.

[21] Appl. No.: 760,046

[22] Filed: Jul. 29, 1985

[51] Int. Cl.[4] ..... B28C 5/16; B01F 7/26; B02C 7/08; B02C 7/12

[52] U.S. Cl. ..... 366/1; 366/296; 366/315; 366/317; 241/253; 241/261.3; 241/296

[58] Field of Search ..... 366/1, 2, 293, 294, 366/296, 315, 316, 317; 241/251, 253, 261.3, 296, 257 R, 258, 259, 261.2, 297

[56] References Cited

U.S. PATENT DOCUMENTS

| | | | |
|---|---|---|---|
| 666,001 | 1/1901 | Ditto | 241/253 |
| 954,511 | 4/1910 | Gordon | 366/320 |
| 1,269,399 | 6/1918 | Davis | 366/294 |
| 1,393,632 | 10/1921 | Mitchell | 366/317 X |
| 1,556,870 | 10/1925 | Nelson | 241/296 |
| 1,670,714 | 5/1928 | Craig | 241/253 X |
| 1,927,620 | 9/1933 | Tolman | 366/176 X |
| 2,412,680 | 12/1946 | Fischer et al. | 241/296 X |
| 2,851,257 | 9/1958 | Morgan | 366/320 X |
| 3,290,018 | 12/1966 | Stapelfeldt | 366/2 |
| 3,877,881 | 4/1975 | Ono et al. | 366/323 X |
| 4,225,247 | 9/1980 | Hodson | 366/312 X |

FOREIGN PATENT DOCUMENTS

| | | | |
|---|---|---|---|
| 1589957 | 5/1970 | France | 241/296 |

*Primary Examiner*—Harvey C. Hornsby
*Assistant Examiner*—Scott J. Haugland
*Attorney, Agent, or Firm*—Spensley Horn Jubas & Lubitz

[57] ABSTRACT

A rotary mill to colloidalize a premixed mortar in a high energy manner so as to increase the degree of hydration comprising a hollow collector casing having a feed inlet to receive the premixed mortar and a discharge outlet for the mixed product, a pair of counterrotating members cooperatively forming a shear zone therebetween wherein the shear zone comprises an inlet region to receive the premixed mortar from the feed inlet, a convergency region to impart a high energy shear to the premixed mortar and an expanding discharge region to feed the premixed mortar to the discharge outlet, and a drive and drive train coupled to the counterrotating members to impart rotational movement thereto.

2 Claims, 1 Drawing Sheet

ROTARY MILL

BACKGROUND OF THE INVENTION

1. Field of the Invention

This invention relates to a colloidal mill specifically designed to mix a premixed mortar in a high energy manner so as to provide a high degree of hydration.

2. Description of the Prior Art

As is well recognized in the construction and building industry concrete is used generically to define a collection or aggregation of materials which together form a reasonably continuous and consistent solid when cured. In conventional applications of concrete products voids, and/or small discontinuities or inclusions of air within the resulting product, are considered to be highly underdesirable. This is true since such voids normally affect the operating or performance characteristics of the product in a harmful manner.

However, in a certain specialized category of concrete such voids are intentional for the purpose of producing what is known as a porous concrete. While porous concrete is generally well known in the prior art such products frequently suffer from inherent problems, such as a weakness or a lack of structural integrity, which makes the overall product relatively undesirable.

The following U.S. Patents disclose prior art products and/or methods of forming concrete products or cementitious material which is generally applicable but clearly distinguishable from the product which is formed through the utilization of the machine or assembly of the present invention: U.S. Pat. Nos. 2,710,802 to Lynch; 3,582,88, to Moore; 1,665,104, to Martienssen; 3,196,122 to Evans; 3,240,736, to Beckwith; 3,360,493, to Evans; 3,429,450 to Richards; 3,477,979, to Hillyer; 3,687,021, to Hinsley; 3,690,227, to Weltry; 3,870,422, to Medico; 2,130,498, to Klemschofski; 3,822,229, to McMaster; 954,511, to Gordon; 2,851,257, to Morgan; 3,877,881 to Ono and 4,225,247, to Hodson. Additional prior art can be found in U.S. Pat. Nos. 666,001, to Ditto; 1,670,714, to Craig, and 1,927,620, to Tolman.

The products of the type generally disclosed in the above set forth U.S. patents frequently suffer from certain inherent disadvantages. Such disadvantages include failure under heavy load or stress conditions as in highway construction. However, there is an acknowledged need in the construction industry, especially in the area of building roads, highways, bridges, etc. for a porous concrete type product. Such preferred porous contrete product should further be able to stand high load or stress conditions for high speed operation of large or heavy motor vehicles. Other uses of a porous concrete product are available once the desirable performance and operating characteristics of such a product has been established.

In previous concrete, a high shear mixer produces a cementwater component of high strength and increased viscosity. This results in a high strength structure in the final discontinuous concrete. However, the process of combining or mixing cement and water can be carried much further, although not necessarily of benefit in pervious concrete, since a greater intensity of fine particle mixing produces a cement-water combination of paint-like consistency, which sets to a glass-like surface, not appropriate to pavement.

However, with proper techniques, such a supermixed mortar can be directly sprayed, painted or otherwise applied to cement products, and with proper curing processes produces a gloss finish surface which is more durable than normal concrete, and which has an appearance similar to glazed ceramic tile. By the use of white cement (in place of grey) and standard and organic mineral colors, many decorative effects can be obtained. Experience has shown that the surface produced is extremely durable, although its Mohr hardness value is below the level of kiln-fired ceramics. For example, it can be scratched by martensitic steel if a blade or tool is applied with sufficient pressure, or by abrasion with silicon compounds.

In explanation of this result, it appears that, in general, high energy mixing further colloidalizes the cement, water fraction, and produces a new mortar form proportional to the intensity of mixing which results in combination and hydration at much finer particle sizes than is accomplished by present mixing methods. It should be noted that the limitation of particle fineness in cement clinker grinding during production, as presently practiced, is to prevent shrinkage, surface crazings, and cracking thought to be a hydration effect.

However, the colloidalized mortar shows no signs of such defects. Apparently, the colloidalizing process accelerates exothermic behavior so as not to protract heat loss and shrinkage factors in the setting phase. At the same time it appears to produce more of the strength intrinsically available from the hydration of cement as indicated by the know quality to re-grind set concrete, which may then be mixed with water, when it will again generate some setting strength illustrating its full potential is not reached in normal concrete practice.

Assuming a strength increase as high as may be expected from recognized re-grinding and remixing data, it should be possible to considerably reduce the cement content of concretes and still obtain, comparable strengths. In adition, this idea can be extended to the use of pozzolanic additives, particularly fly ash, which is a by-product of coal-fired furnaces. This will further reduce the cement consumption. It may ultimately be possible to use a lime and fly ash to completely replace cement, without the use of partial fusion, as now practiced in cement production.

It is readily believed that the inherent deficiencies set forth above are due to a failure to fully form the hydrated product when utilizing conventional or currently known techniques as in the formation of substantially conventional concrete or the like. Accordingly, there is an obvious need in the industry for mechanisms and processes of forming concrete utilizing conventional cement, water and aggregate components in a manner which will result in more favorable operating and performance characteristics.

SUMMARY OF THE INVENTION

The present invention relates to a rotary mill specifically designed to mix a premixed mortar or the like in a high energy manner to provide a high degree of hydration. The rotary mill comprises a hollow collector casing having a feed inlet to receive the premixed mortar and a discharge outlet to discharge a colloidal and super mixed product.

A pair of substantially conical counterrotating mixing members operatively disposed within the hollow collector casing cooperatively form a shear zone comprising an inlet region to receive the premixed mortar from the feed inlet, a convergence region to impart a high energy shear to the premixed mortar and a parallel processing region to feed the premixed mortar to the discharge outlet.

The device further includes a drive train comprising an upper and lower drive portion coupled to the counterrotating mixing members.

Premixed mortar is directed by a collector bin which discharges into the rotary mill. The process is achieved be centrifugally forcing the mixture between the counterrotating mixing members. The angle of these conical surfaces is variable, by varying the slope of one cone since the action of the machine is centrifugal.

Alternately the counterrotating mixing members may comprise a pair of substantially horizontal parallel counterrotating mixing or shearing plates each having an oppositely disposed helical groove or ridge formed on adjacent surfaces thereof.

The mixing members are configured to produce the convergency zone which is proportioned to accommodate a uniform volumetric flow in the inlet region finally merging to parallelism in the final discharge region.

In operation, a mortar slurry prepared conventionally is discharged into collector bin, being a guide to direct mortar into the shear zone. In proceeding through the shear zone, the mortar experiences both wet grinding and shear, being finally discharged centrifugally against the internal face of the hollow collector casing.

It should be noted that this particular configuration combines convergence to parallelism, contrifugal action, together with hydrostatic pressure and high speed shearing.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
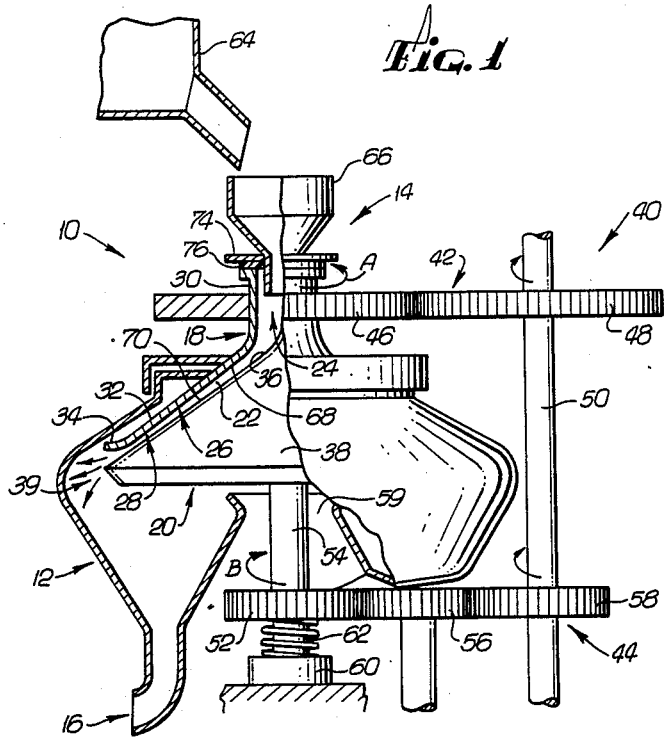
FIG. 1 is a side view in partial cutaway showing the interior of the rotary mill of the present invention.

As shown in FIG. 1, the subject invention is directed to a rotary mill specifically designed to mix a premixed mortar or the like in a high energy manner so as to provide a high degree of hydration. The rotary mill generally indicated as 10 comprises a hollow collector casing generally indicated as 12 having a feed inlet 14 to receive the premixed mortar or the like and a discharge outlet 16 to discharge a colloidal and super mixed product.

A pair of substantially conical counterrotating mixing members generally indicated as 18 and 20 respectively, operatively disposed within the hollow collector casing 12 cooperatively form a shear zone 22 therebetween. The shear zone 22 comprises an inlet region 24 to receive the premixed mortar or the like from the feed inlet 14, a convergence region 26 to impart a high energy shear to the premixed mortar or the like and a parallel processing region 28 to feed the premixed mortar or the like to the discharge outlet 16. The first or upper conical mixing member 18 comprises an upper substantially cylindrical portion 30 having a substantially conical skirt 32 depending downwardly therefrom and terminating in a substantially horizontal shield or splash plate 34 about the lower periphery thereof. The second or lower substantially conical mixing member 20 comprises an upper tapered portion 36 and a lower substantially conical body 38. The splash plate 34 and the lower portion of the conical body 38 defines and expanding discharge region 39.

The device further includes a drive train generally indicated as 40 comprising an upper and lower drive portion 42 and 44 respectively. The upper drive portion 42 comprises an upper gear 46 fixedly attached to the upper portion 30 of the first conical member 18 and disposed to operatively engage an upper drive gear 48 mounted on a drive shaft 50 while the lower drive portion 44 comprises a gear 52 fixedly attached to a shaft 54 operatively disposed to engage an intermediate gear 56 which in turn operatively engages a lower drive gear 58 attached to the lower portion of drive shaft 50. Thus the first and second mixing members 18 and 20 rotate in opposite directions indicated by arrows A and B respectively. The shaft 54 which extends through an aperture 59 formed in lower portion of the hollow collector casing 12 is mounted in thrust bearing 60 having a bias means or take up spring 62 disposed between the upper surface of the thrust bearing 60 and lower surface of the gear 52 to permit vertical movement of the lower or second conical mixing member 20 relative to the first or upper mixing element 18 to permit variations in the effective volume of the shear zone 22. The drive shaft 50 is coupled to a conventional drive means (not shown).

Premixed mortar is fed from appropriate container 64 and directed by a collector bin 66 which discharges into the rotary mill 10. The process is achieved by centrifugally forcing the mixture between the two conical surfaces 68 and 70. The angle of these conical surfaces 68 and 70 is variable, by varying the slope since the action of the machine is centrifugally, but the arrangement shown in FIG. 1 is mechanically desirable.

The first and second mixing members 18 and 20 are configured to produce the convergency zone 26 which is proportioned to accommodate a uniform volumetric flow in the inlet region 24 finally merging to parallelism and final discharge region 39.

The conical mixing members 18 and 20 are rotated at high speed in opposite directions, with the first mixing member 18 in fixed vertical position and the second mixing member 20 biased by spring 62 to permit variations in the volumetric flow of mortar between the mixing members 18 and 20, and thus providing a means of adjusting the degree of wet grinding which occurs.

Figure 3:
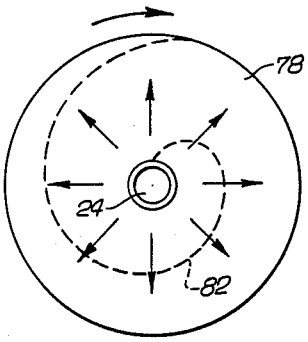
FIG. 3 is an end view of the upper or first shearing plate.
Figure 4:
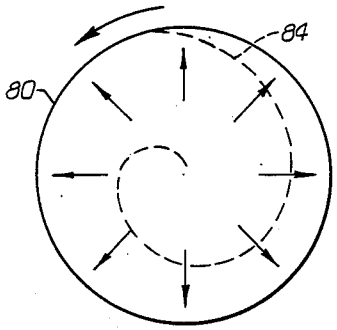
FIG. 4 is an end view of the lower or second shearing plate.
Figure 2:
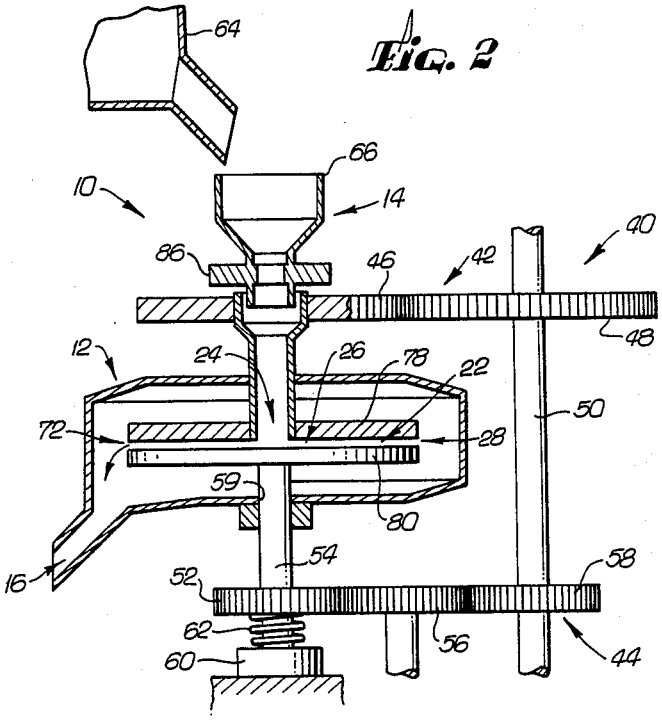
FIG. 2 is a side view in partial cutaway showing the interior of an alternate embodiment of the rotary mill of the present invention.

As shown in FIGS. 2 through 4 the counterrotating mixing or shearing members may comprise a pair of substantially horizontal parallel shearing plates 78 and 80, operatively disposed within the hollow collector casing 12 cooperatively form a shear zone 22 therebetween. The upper or first shearing plate 78 may include a first helical groove or ridge 82 formed on the surface thereof while the lower or second shearing plate 80 may include a second helical groove or ridge 84 formed on the surface thereof. The first and second helical grooves or ridges 82 and 84 are disposed or formed in opposite directions relative to each other.

In operation, a mortar slurry prepared conventionally is discharged into collector bin, being a guide to direct mortar into the shear zone 22. In proceeding through the shear zone 22, the mortar experiences both wet grinding and shear, being finally discharged centrifugally against the internal face of the hollw collector casing 12 at 72.

Spill protection is provided by a cap 74, and a gasket seal 76.

A volumetric feed control valve 86 coupled to a remote control (not shown) may be provided to meter the feed of the premixed mortar to the rotary mill 10.

The material collected is gathered by gravitation and discharged through discharge outlet 16.

It should be noted that this particular configuration combines convergency to parallelism, centrifugal action, together with hydrostatic pressure and high speed shearing.

This provides for higher mortar strengths, more economical cement use in concrete in general or particularly producing much higher strengths in job concrete, greater application of pozzolanic additives, with the possibility of using siliceous by-products, such as fly ash, as a part or complete substitute for cement. This may involve inclusion of lime or less burnt cements in the mix.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. A rotary mill to colloidalize a premixed fluid mortar in a high energy manner so as to increase the degree of hydration comprising a hollow collector casing having a feed inlet to receive the premixed fluid mortar and a discharge outlet for the mixed fluid product, a pair of substantially horizontal parallel counterrotating members cooperatively forming a shear zone therebetween, each of said pair of substantially horizontal parallel counterrotating members including a helical groove formed on the surface thereof extending from substantially the geometric center thereof to the outer edge thereof; said helical grooves of said pair of substantially horizontal parallel counterrotating members being formed in opposite directions relative to each other.

2. A rotary mill to colloidalize a premixed fluid mortar in a high energy manner so as to increase the degree of hydration comprising a hollow collector casing having a feed inlet to receive the premixed fluid mortar and a discharge outlet for the mixed fluid product, a pair of substantially horizontal parallel counterrotating members cooperatively forming a shear zone therebetween each of said pair of substantially horizontal parallel counterrotating members including a helical ridge formed on the surface thereof extending from substantially the geometric center thereof to the outer edge thereof, said helical ridges of said pair of substantially horizontal parallel counterrotating members being formed in opposite directions relative to each other.

* * * * *